United States Patent [19]

Broberg, Jr.

[11] 4,412,565

[45] Nov. 1, 1983

[54] WIRE STRAIGHTENER TOOL

[75] Inventor: Dewey O. Broberg, Jr., Long Grove, Ill.

[73] Assignee: Du-Bro Products, Inc., Wauconda, Ill.

[21] Appl. No.: 368,826

[22] Filed: Apr. 15, 1982

[51] Int. Cl.[3] ..... B21F 1/02

[52] U.S. Cl. ..... 140/123; 72/160

[58] Field of Search ..... 140/123, 106, 147; 72/160, 161; 82/38 R, 39

[56] References Cited

U.S. PATENT DOCUMENTS

| | | | |
|---|---|---|---|
| 313,447 | 3/1885 | Putnam | 82/38 R |
| 652,359 | 6/1900 | Haigh et al. . | |
| 1,268,922 | 6/1918 | Bryan . | |
| 1,824,219 | 9/1931 | Loveless . | |
| 2,219,811 | 10/1940 | Friedman . | |
| 2,517,309 | 8/1950 | Heller . | |
| 2,693,219 | 11/1954 | Heller . | |
| 3,034,385 | 5/1962 | Hester . | |
| 3,326,025 | 6/1967 | Nishioka . | |
| 3,343,574 | 9/1967 | Mersek . | |
| 3,595,277 | 7/1971 | Lefever | 140/147 |
| 3,626,995 | 12/1971 | Keenan, Jr. | 140/106 |
| 3,747,648 | 7/1973 | Bauer | 140/147 |

*Primary Examiner*—Lowell A. Larson
*Assistant Examiner*—Linda McLaughlin
*Attorney, Agent, or Firm*—Hosier, Niro & Daleiden

[57] ABSTRACT

A hand tool is disclosed for straightening wire and includes three elongated rod-like wire straightening members each having a plurality of wire engaging circular ridges spaced longitudinally of the respective straightener member. Link means interconnects the wire straightener members at the ends thereof for pivotal movement relative to the longitudinal axes thereof, between an open position and a closed position. The wire straightener members in the closed position define a longitudinal passageway between the circular wire engaging ridges for receiving a wire and straightening the wire in response to relative longitudinal movement of the wire in the passageway as pressure is applied exteriorly of the wire straightener members. The circular ridges on each wire straightener member are spaced and located to be disposed in gaps between the circular ridges of each other wire straightener member.

15 Claims, 4 Drawing Figures

FIG. 1
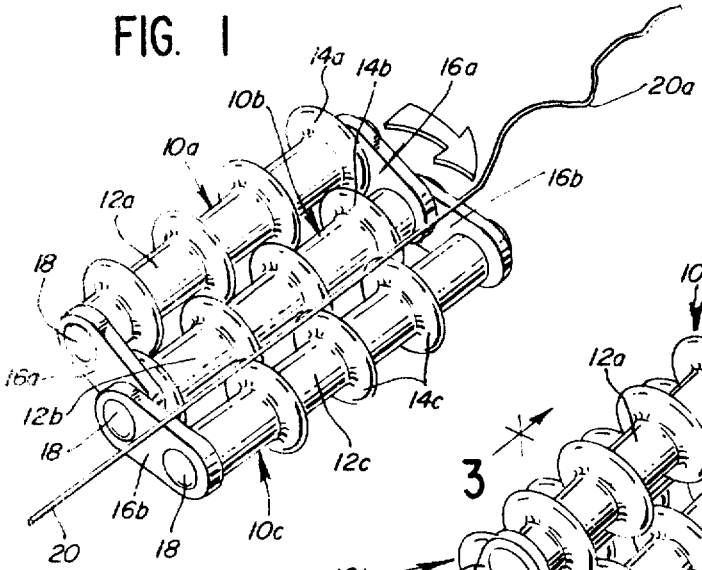
FIG. 2
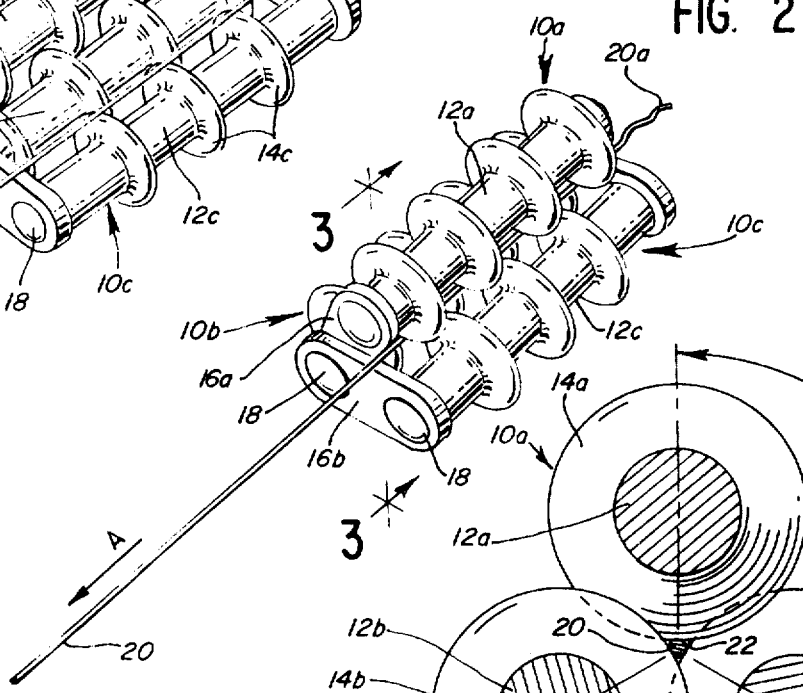
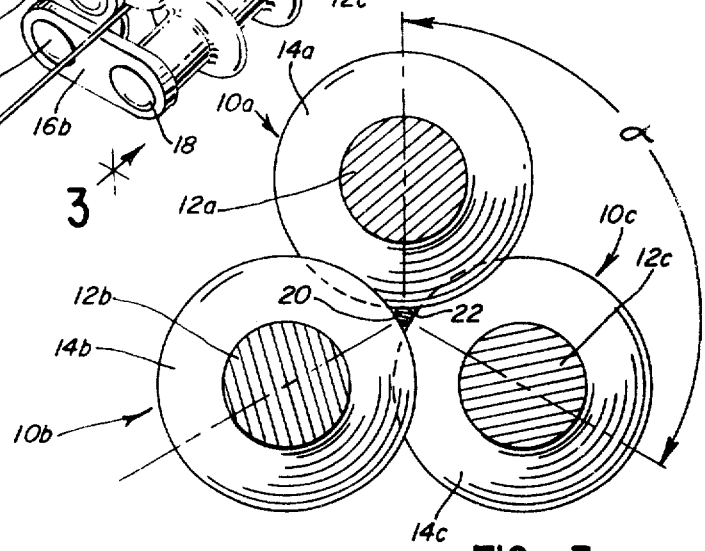
FIG. 3
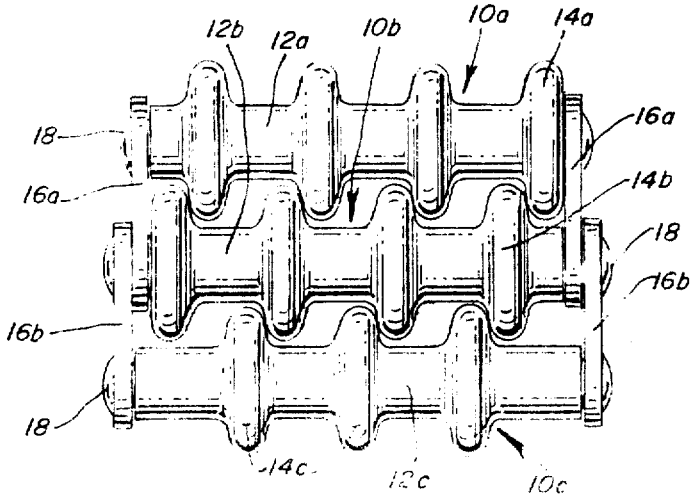
FIG. 4

WIRE STRAIGHTENER TOOL

BACKGROUND AND SUMMARY OF THE INVENTION

This invention relates to a wire straightener tool and, particularly, to a hand tool for straightening wire.

Wire straightening tools or machines have been provided for a variety of applications. For instance, such units have been employed simply for straightening wires which have established a set after being wound on supply rolls. On the other hand, such tools have been employed for straightening bends or kinks which have been formed in wire because of a variety of reasons. In most instances, the wire is moved longitudinally between a plurality of offset roller members, with the wire moving transversely or perpendicular to the axes of the rollers.

For instance, in U.S. Pat. No. 2,517,309 to R. D. Heller, wires are passed between a plurality of offset rollers whereby cumulative deflections of the wire away from and back to the wire strand's path effects straightening of the wire.

Offset rollers for straightening wires also have been employed in hand tools with the wire, again, passing between the rollers in a direction generally transversely or perpendicular to the axes of the rollers. For instance, in U.S. Pat. No. 3,747,648 to G. H. Bauer, a pliers-type tool employs a pair of rollers on one jaw of the pliers and a single roller on the opposed jaw. However, such a hand tool does not afford the cumulative deflections of the wire away from and back to the wire strand's path and, thus, is less effective.

There is a need for an effective hand tool for straightening wires of relatively high tensile strength. For instance, it would be desirable to afford a tool designed for simple hand use such as strengthening wire fishing line which, in ocean fishing, is fabricated of relatively stiff spring wire. The use of rollers or other equivalent means in such a hand tool would be inappropriate because of the limited number of deflections that can be afforded in a simplified, inexpensive tool. The risk of loss of such tools with outdoor activities prohibits the use of a complicated, expensive tool which would be fabricated of multiple components or parts.

The present invention is directed to satisfying this need of a simple, inexpensive hand tool for straightening wire, such as relatively stiff spring wire, and yet provide cumulative deflections of the wire during straightening.

An object, therefore, of the present invention is to provide a new and improved wire straightener tool and, particularly, a simple hand tool for straightening wire.

In the exemplary embodiment of the invention, three elongated rod-like wire straightening members each have a plurality of circular wire engaging ridges spaced longitudinally of the respective straightener member. Link members interconnect the wire straightener members for pivotal movement relative to the longitudinal axes thereof between an open position and a closed position. The wire straightener members in the closed position are generally triangularly disposed and define a longitudinal passageway between the circular wire engaging ridges. The passageway receives a wire and the circular ridges straighten the wire in response to relative longitudinal movement of the wire in the passageway as selective hand pressure is applied exteriorly of the wire straightener members.

The circular ridges on each wire straightener member are spaced and located to be disposed in gaps between the circular ridges of each other wire straightener member when in the closed position.

The link members are of equal length and are secured between adjacent ends of the wire straightener members at opposite ends of the tool.

The tool itself comprising the aforesaid components is sized so as to be capable of being grasped within the palm of a normal human hand whereby selective pressure is easily applied to the tool as the wire is moved longitudinally thereof.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a perspective view of the wire straightener hand tool of the present invention in open condition;

FIG. 2 is a perspective view of the tool, similar to FIG. 1, with the tool in closed condition;

FIG. 3 is a sectional view, on an enlarged scale, taken generally along line 3—3 of FIG. 2; and FIG. 4 is an elevational view of the tool in open condition to better illustrate the relative disposition of the wire engaging circular ridges.

DETAILED DESCRIPTION OF THE INVENTION

Referring to the drawings in greater detail and first to FIGS. 1 and 2, the wire straightener hand tool of the present invention includes three elongated wire straightener members, generally designated 10*a*, 10*b* and 10*c*. Each wire straightener member 10*a*–10*c* is fabricated of ridged, hard material such as brass and includes an axial rod portion 12*a*–12*c*, respectively. Each wire straightener member 10*a*–10*c* has a plurality of circular wire engaging ridges 14*a*–14*c*, respectively, formed integrally with and protruding outwardly of the rod portions 12*a*–12*c*, respectively. The circular ridges are spaced longitudinally of the respective wire straightener member.

Link means interconnects the wire straightener members for pivotal movement relative to the longitudinal axes thereof between an open position (FIG. 1) and a closed position (FIG. 2). More particularly, a pair of generally flat link members 16*a*, 16*b* are secured between adjacent ends of the wire straightener members at opposite ends of the tool. Appropriate rivets or screws 18 secure the link members to the ends of the wire straightener members but permit free pivotal movement therebetween. It can be seen in FIGS. 1 and 2 that both link members 16*a*, 16*b* of both pairs thereof are secured to the central wire straightener member 10*b*. Link member 16*a* also secures wire straightener member 10*a*, and link member 16*b* also secures wire straightener member 10*c*. The link members are of equal length whereby the wire straightener members are capable of defining a longitudinal passageway between the circular ridges when the tool is in closed position (FIG. 2), as described in greater detail below.

In operation, FIG. 1 shows the tool in open position with a wire 20, having bends or kinks 20*a*, laid in a longitudinal, generally V-shaped zone defining by circular ridges 14*b*, 14*c* of wire straightener members 12*b*, 12*c* respectively. The tool then is closed to the generally triangular configuration shown in FIG. 2 whereby the circular ridges 14*a*–14*c* of all three wire straightener members completely encapsulate the wire. The wire then is moved longitudinally in the direction of arrow A as selective pressure is applied exteriorly of the wire straightener members. Cumulative deflections of the wire caused by the circular ridges effect straightening of the wire and removal of the bends or kinks 20*a*. Of course, the wire may be held stationary and the tool itself moved opposite the direction of arrow A.

FIG. 3 shows the transverse disposition of the wire straightener members when in closed position as shown in FIG. 2. With the link members being of equal length, it can be seen that the center axes of the wire straightener members are disposed angularly about the center of passageway 22 at equal 120° angles $\alpha$. This equal angular disposition of the wire straightener members, in combination with the equal length link members, effects equal pressure distribution onto wire 20 disposed in passageway 22.

FIG. 4 best illustrates the manner in which cumulative deflections of the wire are afforded by the simple tool of the present invention. It can be seen that the circular wire engaging ridges 14*a*–14*c* of wire straightener members 10*a*–10*c*, respectively, are spaced and located along the respective wire straightener members so as to be disposed in gaps between the circular ridges of each other wire straightener member. FIG. 4 shows the tool in open condition, but the ridges maintain their relative disposition when in the closed position of FIGS. 2 and 3 while engaging a wire. Although the circular ridges on any one wire straightener member are equally spaced, it can be seen that by providing four ridges on wire straightener member 10*a*, four ridges on wire straightener member 10*b*, and three ridges on wire straightener member 10*c*, an alternate positioning of the ridges is effected. The gaps between any two ridges on any one wire straightener member are wide enough to accommodate two ridges of the other two wire straightener members. The relative simplicity of manufacture is apparent. For instance, wire straightener members 10*a* and 10*b* are identical but simply reversed in an end-wise relationship. With the multiple wire engaging ridges, it can be seen that cumulative deflections away from and back to the wire strand's path through passageway 22 are effected by a very simple hand tool; a tool which includes only seven major components comprising the three wire straightener members and the four end link members. Heretofore, such cumulative deflections to effect straightening of relatively stiff spring wire or other high tensile strength wire could be afforded only by much more complicated machines, yet the hand tool of the present invention can be disposed and operated within the palm of one's hand.

It will be understood that the invention may be embodied in other specific forms without departing from the spirit or central characteristics thereof. The present examples and embodiments, therefore, are to be considered in all respects as illustrative, and the invention is not to be limited to the details given herein.

What is claimed is:

1. A hand tool for straightening wire, comprising: at least three elongated wire straightener members each having a plurality of wire engaging surfaces spaced longitudinally of the respective straightener member; and means interconnecting said wire straightener members for pivotal movement about axis means extending generally parallel to the longitudinal axes of the wire straightener members between an open position and a closed position with the wire straightener members in said closed position defining a longitudinal passageway between said wire engaging surfaces extending generally parallel to the longitudinal axes of the wire straightener members for receiving a wire and straightening the wire in response to relative longitudinal movement of the wire in said passageway as pressure is applied exteriorly of the wire straightener members.

2. The hand tool of claim 1 wherein said wire engaging surfaces are generally annular about the axis of their respective elongated wire straightener member.

3. The hand tool of claim 2 wherein said wire straightener members each comprise a rod with circular ridges defining said wire engaging surfaces.

4. The hand tool of claim 1 wherein said spaced wire engaging surfaces are located along each wire straightener member with respect to the wire engaging surfaces of the other straightener members such that each wire engaging surface is disposed in a gap between a pair of wire engaging surfaces on each other wire straightener member in said closed position.

5. The hand tool of claim 4 wherein the circular ridges on each wire straightener member are spaced and located to be disposed in gaps between the circular ridges of each other wire straightener member in said closed position.

6. The hand tool of claim 1 wherein said interconnecting means comprises link members between one of said wire straightener members and the other wire straightener members.

7. The hand tool of claim 6 wherein said link members are secured between adjacent ends of the wire straightener members at opposite ends of the tool.

8. The hand tool claim claim 7 wherein the link members are of equal length.

9. A hand tool for straightening wire, comprising: three elongated rod-like wire straightener members each having a plurality of wire engaging circular ridges spaced longitudinally along the respective wire straightener member, link means interconnecting said wire straightener members for pivotal movement relative to the longitudinal axes thereof between an open position and a closed position, said wire straightener members in said closed position defining a longitudinal passageway between said circular ridges for receiving a wire and straightening the wire in response to relative longitudinal movement of the wire in said passageway as pressure is applied exteriorly of the wire straightener members, said circular ridges on each wire straightener member being spaced and located to be disposed in gaps between the circular ridges of each other wire straightener member.

10. The hand tool of claim 9 wherein said link means comprise link members secured between adjacent ends of one of said wire straightener members and the other wire straightener members.

11. The hand tool of claim 10 wherein said link members are of equal length.

12. The hand tool of claim 9 wherein said wire straightener members are of a size so as to be capable of nesting in the palm of a normal human hand whereby selective pressure can be applied on the wire straightener members when in said closed position.

13. A hand tool for straightening wire, comprising: at least three elongated wire straightener members each having a plurality of wire engaging surfaces spaced longitudinally of the respective straightener member; and link members between one of said wire straightener members and the other wire straightener members to interconnect the wire straightener members for pivotal movement relative to the longitudinal axes between an open position and a closed position with the wire straightener members in said closed position defining a longitudinal passageway between said wire engaging surfaces for receiving a wire and straightening the wire in response to relative longitudinal movement of the wire in said passageway as pressure is applied exteriorly of the wire straightener members.

14. The hand tool of claim 13 wherein said link members are secured between adjacent ends of the wire straightener members at opposite ends of the tool.

15. The hand tool of claim 14 wherein the link members are of equal length.

* * * * *